US010118422B2

(12) United States Patent
Arakawa

(10) Patent No.: US 10,118,422 B2
(45) Date of Patent: Nov. 6, 2018

(54) INK-JET RECORDING APPARATUS

(71) Applicant: BROTHER KOGYO KABUSHIKI KAISHA, Nagoya-shi, Aichi-ken (JP)

(72) Inventor: Yuta Arakawa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/718,968

(22) Filed: Sep. 28, 2017

(65) Prior Publication Data

US 2018/0178564 A1 Jun. 28, 2018

(30) Foreign Application Priority Data

Dec. 28, 2016 (JP) ..... 2016-255349

(51) Int. Cl.
*B41J 23/02* (2006.01)
*B41J 2/01* (2006.01)

(52) U.S. Cl.
CPC ..... *B41J 23/02* (2013.01); *B41J 2/01* (2013.01)

(58) Field of Classification Search
CPC ..... B41J 23/02; B41J 3/4075
See application file for complete search history.

(56) References Cited

U.S. PATENT DOCUMENTS 6,848,685 B2 * 2/2005 Katsuyama ..... B41J 13/103 271/162
7,464,922 B2 * 12/2008 Kozaki ..... B65H 3/0669 271/118
8,118,415 B2 * 2/2012 Kanbe ..... B41J 2/17509 347/85
9,751,706 B2 * 9/2017 Shimizu ..... B65H 3/0684
2009/0035018 A1 2/2009 Koga et al.
2009/0035019 A1 2/2009 Koga et al.
2013/0257987 A1 10/2013 Wakakusa

FOREIGN PATENT DOCUMENTS

JP 2009034832 A 2/2009
JP 2013208720 A 10/2013

* cited by examiner

*Primary Examiner* — Lamson Nguyen
(74) *Attorney, Agent, or Firm* — Merchant & Gould P.C.

(57) ABSTRACT

An ink-jet recording apparatus, including: a carriage; a lever rotatable about an axis of a shaft and including a lever arm; and a guide having an elongate hole defined by a first edge portion having stoppers for retaining the lever arm and a second edge portion, wherein the guide having an inclined portion including an inclined surface for rotating the lever arm toward the second edge portion and formed downstream of the stoppers in a first direction, wherein the biasing member biases the lever in a second direction opposite to the first direction and in a direction directed from the second edge portion toward the first edge portion, and wherein a distance between: a first position where the inclined surface and the lever arm contact; and the axis of the shaft is larger than a distance between: a second position where each stopper contacts the lever arm; and the axis.

8 Claims, 12 Drawing Sheets

INK-JET RECORDING APPARATUS

CROSS REFERENCE TO RELATED APPLICATION

The present application claims priority from Japanese Patent Application No. 2016-255349, which was filed on Dec. 28, 2016, the disclosure of which is herein incorporated by reference in its entirety.

BACKGROUND

Technical Field

The present disclosure relates to an ink-jet recording apparatus configured to perform image recording such that a carriage on which a recording head is mounted moves in a main scanning direction, and in particular to such an ink-jet recording apparatus in which a force output from a drive source is selectively transmitted to a plurality of drive portions.

Description of Related Art

There is known an ink-jet recording apparatus configured to record an image on a sheet by ejecting ink based on input signals. For transmitting, to a plurality of drive portions, the force output from one drive source, the known ink-jet recording apparatus switches a destination of transmission of the force output from the drive source.

The known ink-jet recording apparatus includes a lever member. A guide member is disposed in a main body of the ink-jet recording apparatus. The guide member has an elongate hole extending in the main scanning direction. The lever member passes through the elongate hole. The lever member is pushed by the carriage that is moving, so as to slide in the main scanning direction while being guided by the elongate hole. A plurality of stopper portions are formed at an edge portion of the elongate hole. Each stopper portion is configured to retain the lever member. The lever member pushed by the carriage slides in the main scanning direction and is retained by one of the stopper portions, so that the lever member is positioned. The destination of transmission of the force output from the drive source is switched in accordance with the position of the lever member.

SUMMARY

For enabling the lever member to be disengaged from the stopper portions, the lever member of the known ink-jet recording apparatus is pivotable about an axis extending in the main scanning direction. The edge portion of the elongate hole of the guide member has inclined portions formed so as to be inclined with respect to the main scanning direction, and the lever member pivots such that the lever member comes into contact with the inclined portion and is guided by the inclined portion.

In an instance where the ink-jet recording apparatus is used in a dusty environment, foreign matters such as dust may enter the main body of the ink-jet recording apparatus through an opening or a clearance formed in the main body. If the foreign matters adhere to the lever member and the inclined portions of the guide member, there may be a risk of increase in a load that acts on the lever member when the lever member pivots while being guided by the inclined portions. The increased load may be applied from the lever member to the drive source of the carriage via the carriage. If the drive source receives a load larger than its stall torque, the drive source stops to operate.

Accordingly, an aspect of the disclosure relates to an ink-jet recording apparatus which enables the lever member to keep pivoting irrespective of the load that acts on the lever member.

In one aspect of the disclosure, an ink-jet recording apparatus includes: a carriage on which a recording head is mounted and which is configured to reciprocate in a main scanning direction composed of a first direction and a second direction which are opposite to each other; a lever including a lever arm that protrudes into a movement region of the carriage and configured to be slidable in the main scanning direction and rotatable about an axis of a shaft supporting the lever, the axis being parallel to the main scanning direction; a first gear configured to rotate by a drive force transmitted from a drive source; a second gear meshing with the first gear and configured to be slidable to a plurality of slide positions along the main scanning direction in accordance with a sliding movement of the lever; a plurality of transmission gears parallelly disposed so as to correspond to the plurality of slide positions of the second gear, each of the transmission gears being configured to mesh with the second gear at a corresponding one of the plurality of slide positions of the second gear; a guide having an elongate hole into which the lever arm is inserted, the guide being configured to position the lever arm with respect to a plurality of positions corresponding to the plurality of slide positions of the second gear; and a biasing member configured to bias the lever, wherein the elongate hole is defined by a periphery including a first edge portion and a second edge portion which extend in the main scanning direction and which are opposed to each other, the first edge portion including a plurality of stoppers by each of which the lever arm is retained at a corresponding one of the plurality of positions, wherein an inclined portion including an inclined surface is formed at the first edge portion so as to be located downstream of the stoppers in the first direction in which the carriage pushes the lever arm, the inclined surface being inclined with respect to the main scanning direction and configured to contact the lever arm so as to rotate the lever arm toward the second edge portion, wherein the biasing member biases the lever in the second direction opposite to the first direction and in a direction directed from the second edge portion toward the first edge portion, and wherein a distance in a radial direction of the shaft between: a first position at which the inclined surface and the lever arm contact each other; and the axis of the shaft is larger than a distance in the radial direction of the shaft between: a second position at which each of the stoppers contacts the lever arm; and the axis of the shaft.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

Figure 1:
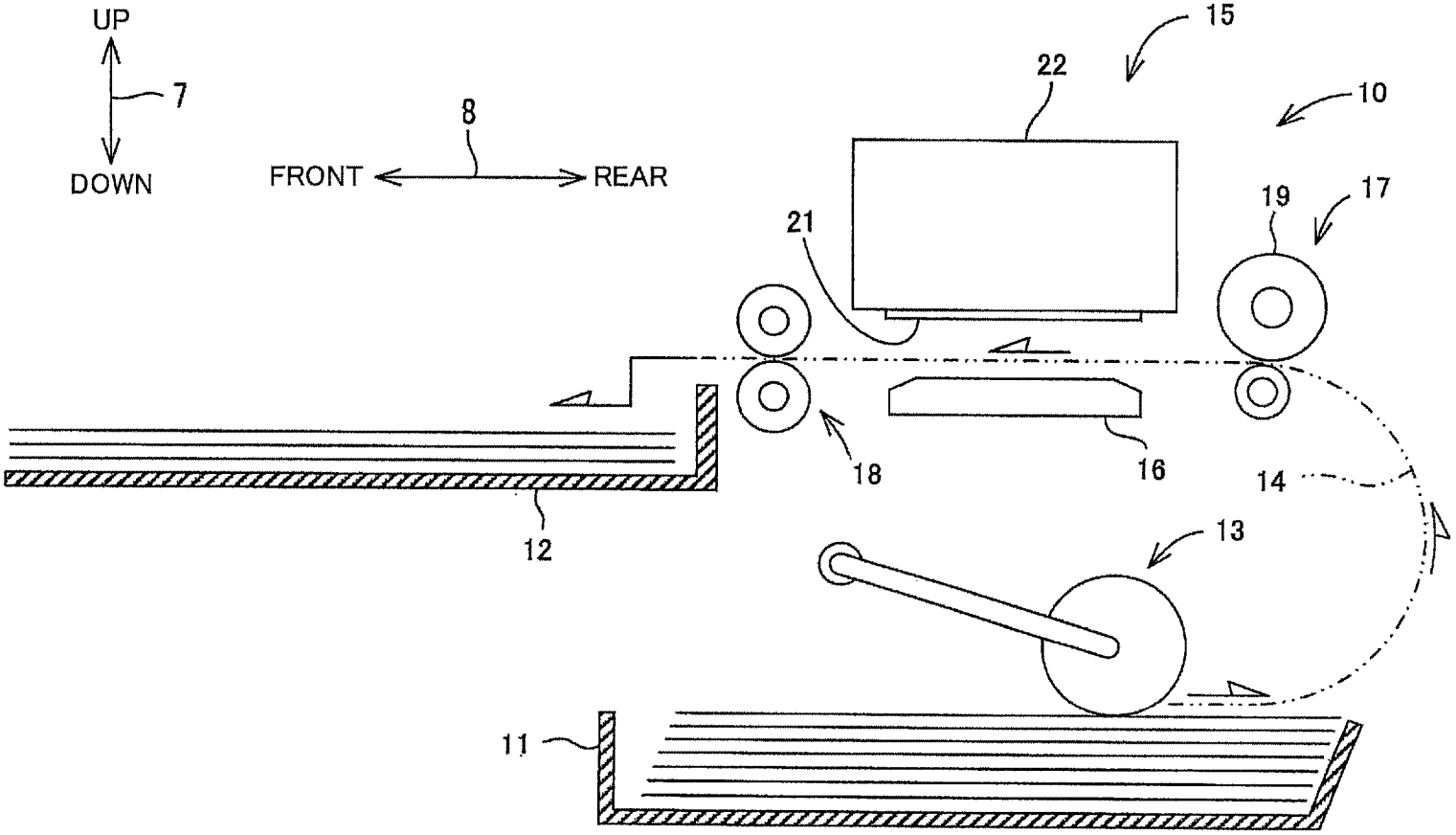
FIG. 1 is a cross-sectional view schematically showing an internal structure of a printer according to one embodiment.

There will be explained one embodiment referring to the drawings. It is to be understood that the following embodiment is described only by way of example, and the disclosure may be otherwise embodied with various modifications without departing from the scope of the disclosure. In the following explanation, an up-down direction 7 (FIG. 1) is defined with respect to an attitude of a printer 10 horizontally placed in its operative position. A front-rear direction 8 (FIGS. 1 and 2) is defined by regarding, as a front direction, a direction in which a sheet-supply tray 11 is removed from a housing of the printer 10. A right-left direction 9 (FIG. 3) is defined in a state in which the printer 10 is viewed from a front side. The up-down direction 7, the front-rear direction 8, and the right-left direction 9 are orthogonal to each other.

Overall Structure of Printer 10

As shown in FIG. 1, the printer 10 (as one example of "ink-jet recording apparatus") is connected mainly to an external information device such as a computer. The printer 10 records images and characters on a recording medium based on print data including image data and document data transmitted from the external information device. Various sorts of storage media such as memory cards may be loaded on the printer 10, and the printer 10 is capable of recording images on the recording medium based on image data stored in the storage media. The recording medium used in the printer 10 includes paper sheets and resin sheets, for instance.

The printer 10 includes the sheet-supply tray 11 and a sheet-discharge tray 12. The sheet-supply tray 11 is disposed below the sheet-discharge tray 12. The sheet-supply tray 11 is inserted rearward into the housing of the printer 10, so as to be mounted on the printer 10. The sheet-supply tray 11 is removed frontward from the housing of the printer 10. The sheet-supply tray 11 stores sheets, each as a recording medium, in various standard sizes such as an A4 size, a B5 size, and a postcard size which are smaller than a legal size, for instance. Each of the sheets stored in the sheet-supply tray 11 is supplied to a conveyance path 14 by a sheet-supply roller 13. A desired image is recorded by a recording unit 15 on the sheet supplied to the conveyance path 14, and the sheet is thereafter discharged to the sheet-discharge tray 12.

The conveyance path 14 extends upward from an end portion (a right end portion in FIG. 1) of the sheet-supply tray 11, then curves toward the front side of the printer 10, and finally reaches the sheet-discharge tray 12 via the recording unit 15. Each of the sheets stored in the sheet-supply tray 11 is guided by the conveyance path 14 so as to be conveyed upward while making a U turn and reaches the recording unit 15. After an image is recorded on the sheet by the recording unit 15, the sheet is discharged to the sheet-discharge tray 12.

The recording unit 15 is disposed downstream of the U-turned portion of the conveyance path 14 in a conveyance direction 101. The conveyance direction 101 is a direction in which the sheet is conveyed. The conveyance direction 101 is indicated by arrows along the long dashed double-short dashed line in FIG. 1. Further, the conveyance direction 101 is a direction directed to the front side in FIG. 2.

Figure 2:
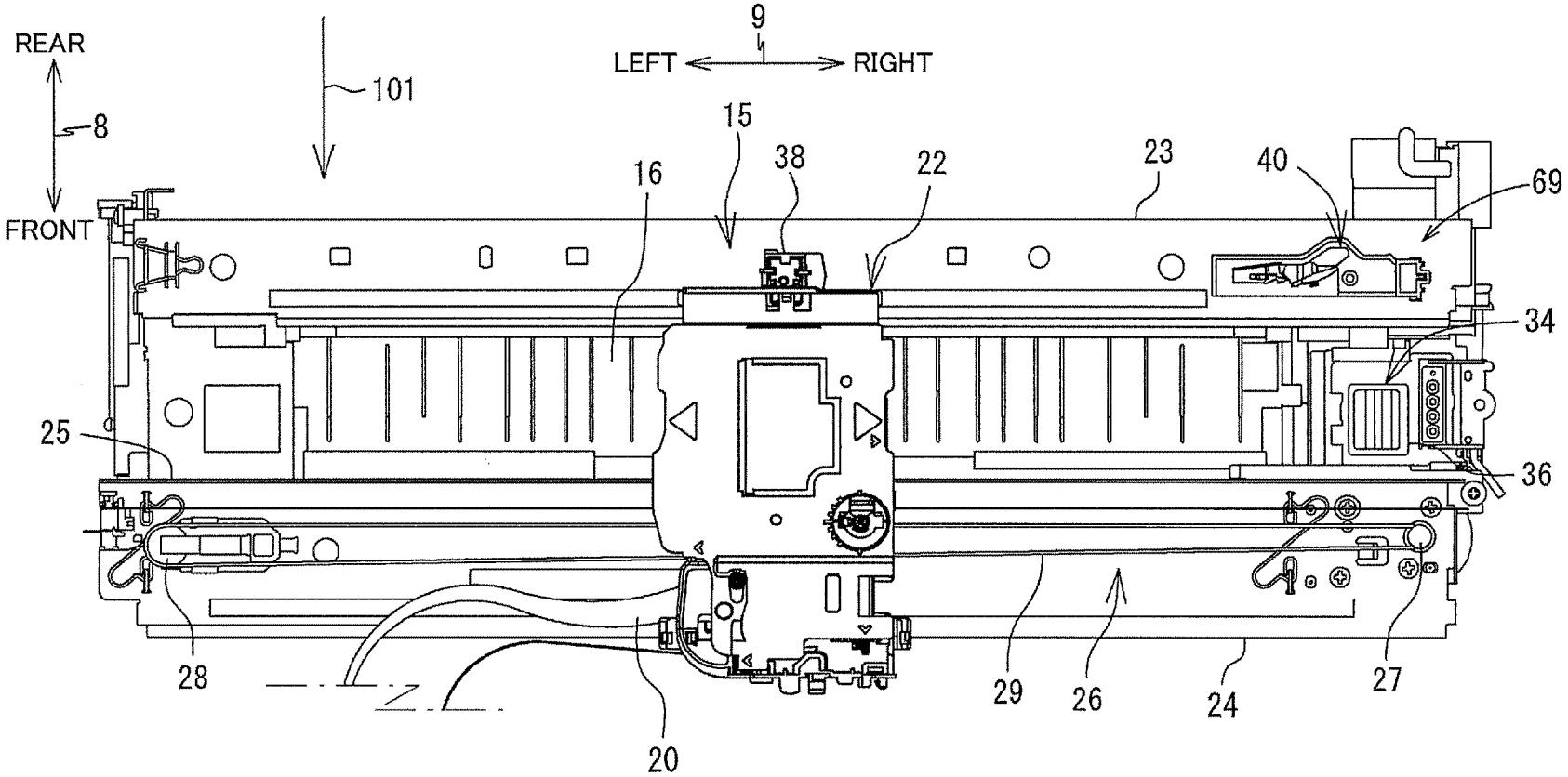
FIG. 2 is a plan view showing a structure of a recording unit.

As shown in FIG. 1, the recording unit 15 includes a recording head 21 and a carriage 22 on which the recording head 21 is mounted and which is configured to reciprocate. Ink cartridges (not shown) are disposed in the printer 10 independently of the recording head 21. To the recording head 21, cyan ink (C), magenta ink (M), yellow ink (Y), and black ink (Bk) are supplied from the respective ink cartridges via respective ink tubes 20 (FIG. 2). A plurality of nozzles are formed in a lower surface of the recording head 21. During the reciprocating movement of the carriage 22, the recording head 21 selectively ejects, from the nozzles, ink of the different colors as minute droplets, so that an image is recorded on the sheet conveyed on the platen 16. The recording unit 15 will be later explained in detail.

A conveyance roller pair 17 is disposed upstream of the recording unit 15 in the conveyance direction 101 while a conveyance roller pair 18 is disposed downstream of the recording unit 15 in the conveyance direction 101. The conveyance roller pairs 17, 18 nip and convey the sheet conveyed through the conveyance path 14. A force of a motor 30 (which will be explained) is transmitted to one roller of the conveyance roller pair 17 and one roller of the conveyance roller pair 18, whereby these rollers rotate. The other roller of the conveyance roller pair 17 rotates following the one roller, and the other roller of the conveyance roller pair 18 rotates following the one roller.

Recording Unit 15

As shown in FIG. 2, a pair of guide rails 23, 24 are disposed above the conveyance path 14 so as to be spaced apart from each other by a predetermined distance in the conveyance direction 101. The guide rails 23, 24 extend in the right-left direction 9. The carriage 22 is disposed so as to bridge the guide rails 23, 24. An upstream end portion of the carriage 22 in the conveyance direction 101 is placed on the guide rail 23 while a downstream end portion of the carriage 22 in the conveyance direction 101 is placed on the guide rail 24. The carriage 22 is slidable on the guide rails 23, 24 in the right-left direction 9 (as one example of "main scanning direction").

An upstream edge portion 25 of the guide rail 24 in the conveyance direction 101 is bent upward at substantially right angle. The carriage 22 slidably nips the edge portion 25 by a nipping member such as a roller pair. Thus, the carriage 22 is positioned with respect to the conveyance direction 101 and is slidable in the right-left direction 9.

A belt driving mechanism 26 is disposed on an upper surface of the guide rail 24. The belt driving mechanism 26 includes a drive pulley 27, a driven pulley 28, a belt 29. The drive pulley 27 is disposed near a right end of the guide rail 24 while the driven pulley 28 is disposed near a left end of the guide rail 24. The belt 29 is an endless belt having teeth on its inner side. The belt 29 is tensioned between the drive pulley 27 and the driven pulley 28. The drive pulley 27 is rotated by a drive force inputted to its shaft from a motor (not shown), whereby the belt 29 is rotated. The belt 29 is not limited to the endless belt, but may be a non-endless belt whose opposite ends are fixed to the carriage 22.

The carriage 22 is fixed at its bottom surface to the belt 29. Thus, the carriage 22 reciprocates on the guide rails 23, 24 along the edge portion 25 in the right-left direction 9 based on the rotation of the belt 29 by the motor. The recording head 21 is mounted on the thus configured carriage 22. That is, the recording head 21 also reciprocates in the right-left direction 9.

As shown in FIG. 1, the platen 16 is disposed below the conveyance path 14 so as to be opposed to the recording head 21. The platen 16 extends over a central portion of the reciprocation range of the carriage 22 on which the sheet passes. The platen 16 has a width larger than a width of a maximum-width sheet that can be conveyed. Thus, widthwise opposite ends of the sheet conveyed through the conveyance path 14 always pass over the platen 16.

As shown in FIG. 2, a purge mechanism 34 is disposed on the right side of the platen 16. The purge mechanism 34 may be disposed on the left side of the platen 16. The purge mechanism 34 is for removing, by suction, air bubbles and foreign matters from the nozzles of the recording head 21.

The purge mechanism 34 includes a cap 36 for covering the nozzles of the recording head 21. The cap 36 is raised and lowered by a known lift-up mechanism, so as to move toward and away from the recording head 21. While not shown in FIG. 2, the purge mechanism 34 further includes a suction pump connected to the cap 36. When the suction pump is activated, the pressure in the cap 36 is reduced to a negative pressure. When the suction pump is activated in a state in which the cap 36 contacts the recording head 21 and covers the nozzles, the air bubbles and the foreign matters are removed by suction from the recording head 21.

While not shown, the printer 10 has a cartridge mount portion. The ink cartridges storing the ink of respective different colors are mounted on the cartridge mount portion. The ink tubes 20 corresponding to the ink of the respective different colors are routed from the cartridge mount portion to the carriage 22. The ink of different colors is supplied from the respective ink cartridges mounted on the cartridge mount portion to the recording head 21 mounted on the carriage 22 via the respective ink tubes 20. The ink tubes 20 are formed of synthetic resin and have flexibility that permits the ink tubes 20 to be flexed following the reciprocating movement of the carriage 22.

Drive Switching Mechanism

Hereinafter, the drive switching mechanism 40 will be explained. The drive switching mechanism 40 is configured to selectively transmit the drive force of the motor 30 to the sheet-supply roller 13, the purge mechanism 34, and other drive portions. As shown in FIG. 2, the drive switching mechanism 40 is disposed rightward of the platen 16. It is noted that the drive switching mechanism 40 may be disposed leftward of the platen 16. In an instance where the drive switching mechanism 40 is disposed leftward of the platen 16, the layout of constituent components of the drive switching mechanism 40 such as gears and a lever member may be suitably changed with respect to the layout of those in an instance where the drive switching mechanism 40 is disposed rightward of the platen 16.

Figure 4:
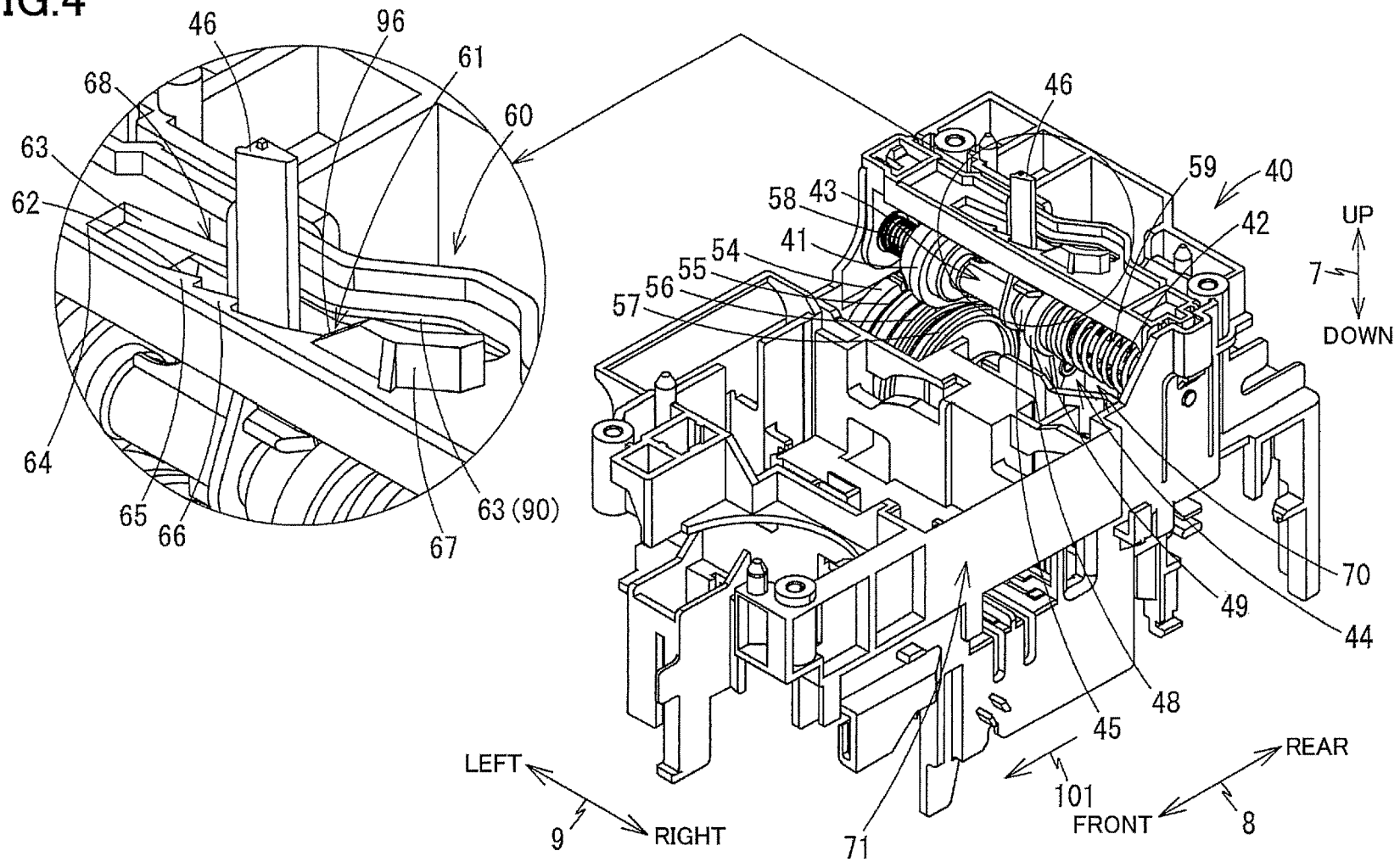
FIG. 4 is a perspective view showing a structure of a drive switching mechanism.

As shown in FIG. 4, the drive switching mechanism 40 includes a drive gear 31, a switch gear 41, transmission gears 54, 55, 56, 57, a lever member 43, a bias switching member 44, coil springs 58, 59, a lever guide 60, and an arm guide 70.

Figure 5:
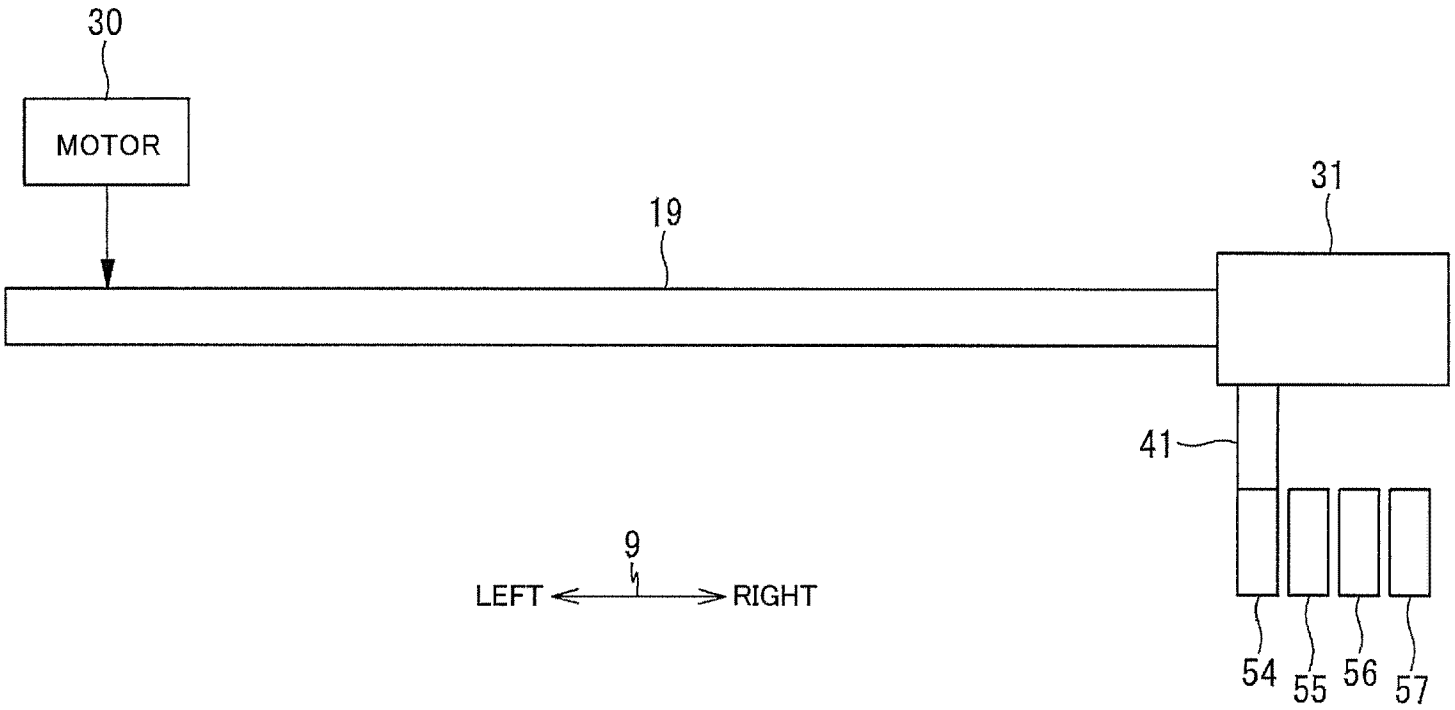
FIG. 5 is a schematic view showing a layout of a drive roller, a drive gear, a switch gear, and transmission gears.

As shown in FIG. 5, the drive force of the motor 30 (as one example of "drive source") is input, via the belt and so on, to a left end of the drive roller 19 (FIG. 1) of the conveyance roller pair 17. The drive gear 31 (as one example of "first gear") is disposed at a right end of the drive roller 19 so as to rotate together with the drive roller 19 about the same axis as the drive roller 19. That is, the drive gear 31 rotates by the drive force transmitted from the motor 30.

The switch gear 41 (as one example of "second gear") is in mesh with the drive gear 31. The switch gear 41 is driven and rotated based on the drive force of the motor 30. As shown in FIG. 4, the switch gear 41 is supported by a shaft 42 so as to be slidable in the right-left direction 9. That is, an axis of the shaft 42 extends along the right-left direction 9. The axis of the shaft 42 is parallel to the axis of the drive gear 31. The drive gear 31 has a length in the right-left direction 9 that is sufficiently large with respect to a slide range of the switch gear 41. Accordingly, the switch gear 41 and the drive gear 31 are always in mesh with each other in the slide range of the switch gear 41.

The transmission gears 54, 55, 56, 57 are disposed below the shaft 42. The transmission gears 54, 55, 56, 57 are parallelly disposed in the right-left direction 9. The transmission gears 54, 55, 56, 57 are rotatably supported by a support shaft (not shown) parallel to the shaft 42 and are rotatable independently of each other. The switch gear 41 slides on the shaft 42, whereby the switch gear 41 meshes with a selected one of the transmission gears 54, 55, 56, 57. That is, the transmission gears 54, 55, 56, 57 are parallelly disposed at respective positions corresponding to the respective slide positions of the switch gear 41.

In the present embodiment, the transmission gear 54 transmits the drive force of the motor 30 to the sheet-supply roller 13. The transmission gear 55 transmits the drive force of the motor 30 to a lower sheet-supply roller (not shown) for supplying the sheet from a lower tray (not shown) disposed below the sheet-supply tray 11. The transmission gear 56 transmits the drive force of the motor 30 to a re-conveyance roller (not shown). The re-conveyance roller is disposed in a return passage (not shown). The return passage is a passage for duplex recording, specifically, for first inverting the sheet having one surface on which an image has been recorded and subsequently conveying the sheet in question again to the recording unit 15. The transmission gear 57 transmits the drive force of the motor 30 to the purge mechanism 34. Thus, the drive force of the motor 30 is transmitted to the drive portions via the respective transmission gears 54, 55, 56, 57.

It is noted that the drive portions are not limited to those in the present embodiment. Further, the drive switching mechanism 40 does not necessarily have to have the four transmission gears 54, 55, 56, 57. In an instance where the printer 10 does not include the lower tray and the return passage, there may be provided spacers in place of the transmission gears 55, 56 in order to locate the transmission gears 54, 57 at respective predetermined positions.

Hereinafter, the lever member 43, the bias switching member 44, the coil springs 58, 59, the lever guide 60, and the arm guide 70 will be explained in detail.

Lever Member 43

As shown in FIG. 4, the lever member 43 is supported by the shaft 42. The lever member 43 is disposed rightward of the switch gear 41.

Figure 6:
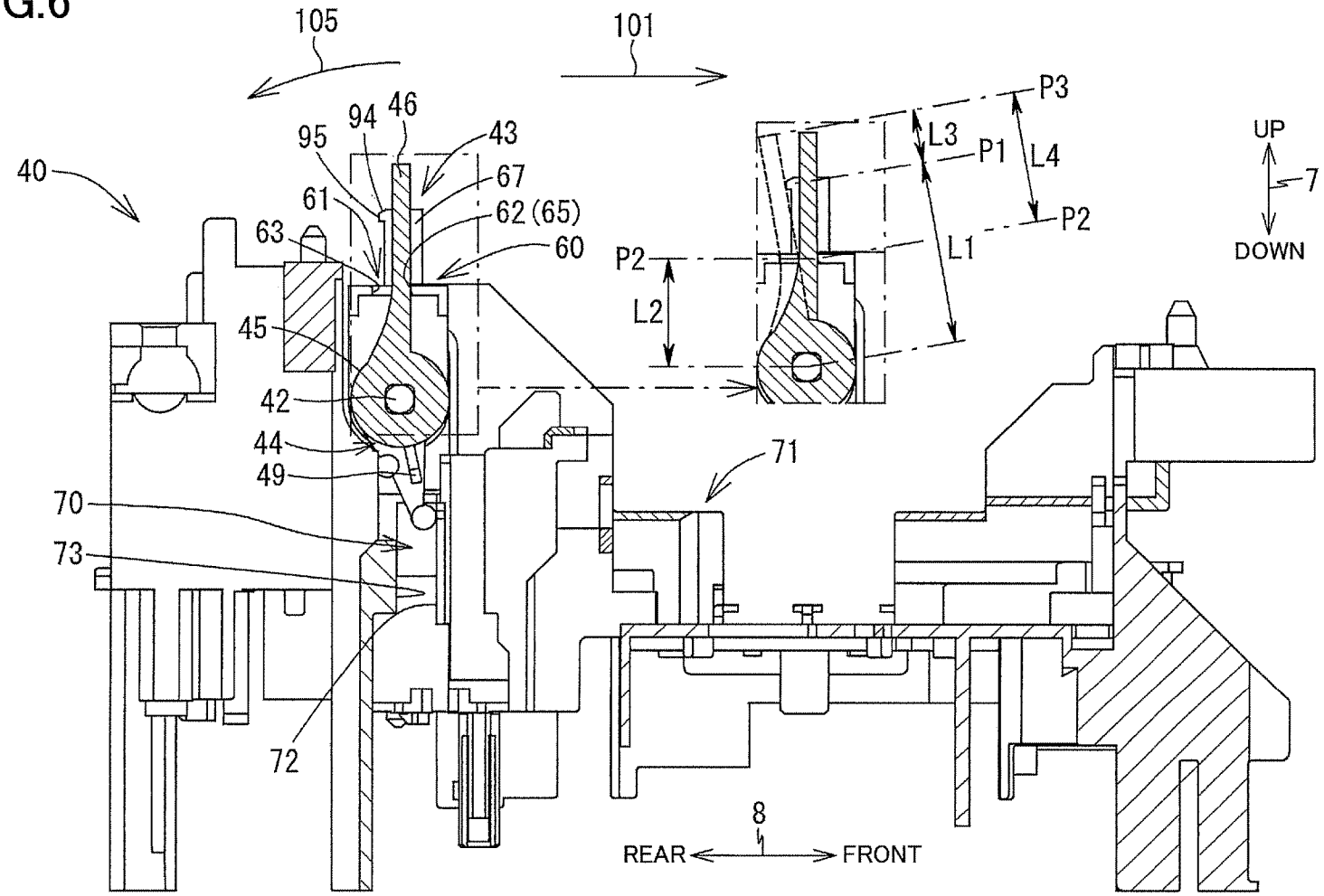
FIG. 6 is a cross-sectional view of the drive switching mechanism cut at a lever member.

As shown in FIGS. 4 and 6, the lever member 43 includes a cylindrical shaft 45 and a lever arm 46. The cylindrical shaft 45 is fitted on the shaft 42. The lever arm 46 protrudes from the cylindrical shaft 45 in a radial direction of the shaft 42, namely, protrudes upward in the present embodiment. The cylindrical shaft 45 is rotatable and slidable in the axial direction of the shaft 42, i.e., in the right-left direction 9. In other words, the lever member 43 is slidable in the right-left direction 9 and rotatable about the axis of the shaft 42.

The left surface of the cylindrical shaft 45 is in contact with the switch gear 41 while the right surface of the cylindrical shaft 45 is in contact with the bias switching member 44. As shown in FIG. 7, a rib 47 extends from an outer circumferential edge of the right surface of the cylindrical shaft 45 in the right-left direction 9.

Bias Switching Member 44

As shown in FIG. 4, the bias switching member 44 (as one example of "biasing member") is supported by the shaft 42. The bias switching member 44 is disposed rightward of the lever member 43.

As shown in FIGS. 4 and 6, the bias switching member 44 includes a cylindrical shaft 48 and a switch arm 49. The cylindrical shaft 48 is fitted on the shaft 42. The switch arm 49 protrudes from the cylindrical shaft 48 in a radial direction thereof, namely, protrudes downward in the present embodiment. The cylindrical shaft 48 is rotatable and slidable in the axial direction of the shaft 42, i.e., in the right-left direction 9. That is, the switch arm 49 is slidable in the right-left direction 9 and rotatable about the axis of the shaft 42.

The left surface of the cylindrical shaft 48 is in contact with the lever member 43. As shown in FIG. 7, a cutout 50 is formed on an outer circumferential edge of the left surface of the cylindrical shaft 48.

A first inclined portion 51 and a second inclined portion 52 are formed on a bottom surface of the cutout 50 of the bias switching member 44. The first inclined portion 51 and the second inclined portion 52 define a triangular shape that protrudes leftward. Each of the first inclined portion 51 and the second inclined portion 52 is a flat surface extending in the radial direction of the shaft 42. The first inclined portion 51 and the second inclined portion 52 are continuous to each other in the circumferential direction of the shaft 42. The rib 47 of the lever member 43 extends into the cutout 50. The distal end of the rib 47 comes into contact selectively with one of the first inclined portion 51 and the second inclined portion 52.

Coil Springs 58, 59

As shown in FIG. 4, the coil springs 58, 59 (each as one example of "biasing member") are fitted on the shaft 42. The coil springs 58, 59 extend and contract in the right-left direction 9.

The coil spring 58 (as one example of "first spring") is disposed on the shaft 42 so as to be located on the left side of the switch gear 41. The switch gear 41 is elastically biased by the coil spring 58 toward the right side, i.e., in the right direction (as one example of "first direction"). That is, the switch gear 41 is elastically biased toward the lever member 43.

The coil spring 59 (as one example of "second spring") is disposed on the shaft 42 so as to be located on the right side of the bias switching member 44. The bias switching member 44 is elastically biased by the coil spring 59 toward the left side, i.e., in the left direction (as one example of "second direction"). That is, the bias switching member 44 is elastically biased toward the lever member 43.

With this configuration, both of the switch gear 41 and the bias switching member 44 are biased toward the lever member 43 by the respective coil springs 58, 59 which respectively apply biasing forces in mutually opposite directions. In other words, the coil spring 58 elastically biases the lever member 43 via the switch gear 41 while the coil spring 59 elastically biases the lever member 43 via the bias switching member 44. Thus, the switch gear 41, the lever member 43, and the bias switching member 44 are in contact with each other on the shaft 42.

The biasing force of the coil spring 59 that biases the bias switching member 44 toward the left side is larger than the biasing force of the coil spring 58 that biases the switch gear 41 toward right side. Therefore, if no external force is applied, the switch gear 41, the lever member 43, and the bias switching member 44 slide on the shaft 42 toward the left side. That is, the coil spring 59 biases the switch gear 41, the lever member 43, and the bias switching member 44 toward the left side.

On the other hand, when an external force in the right direction is applied to the lever member 43, specifically, when the carriage 22 comes into contact with the lever arm 46 and pushes the lever arm rightward, the bias switching member 44 is pushed by the lever arm 46 so as to move rightward. Further, when the lever arm 46 moves rightward, the switch gear 41 moves rightward by the biasing force of the coil spring 58 following the lever arm 46. Thus, the switch gear 41 slides in the right-left direction 9 in accordance with the sliding movement of the lever member 43.

Lever Guide 60

Figure 3B:
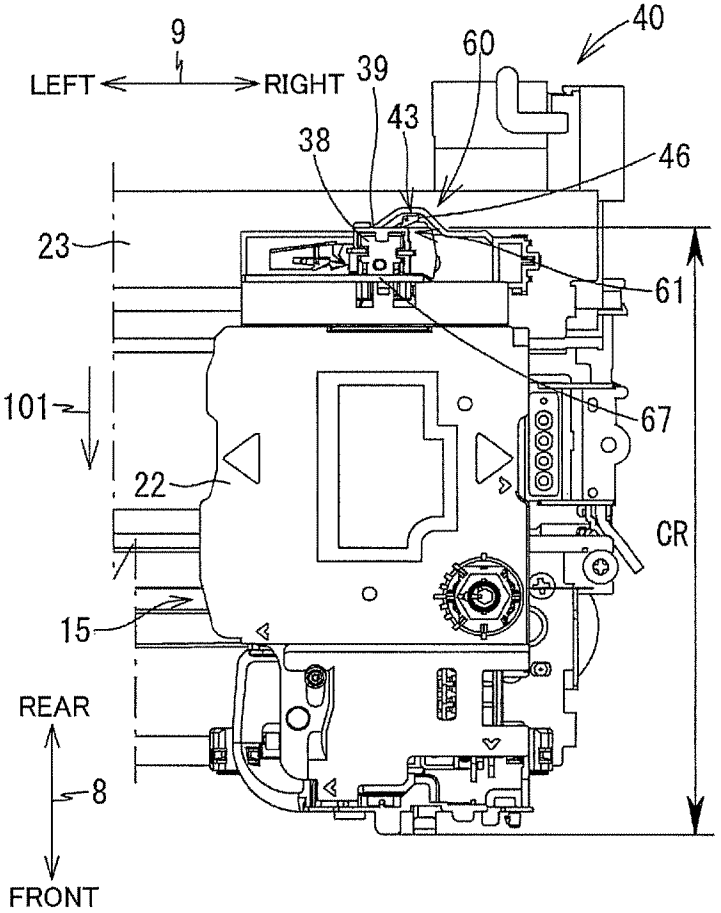
FIG. 3B is a plan view showing the portion of the printer around the carriage and the lever guide.
Figure 3A:
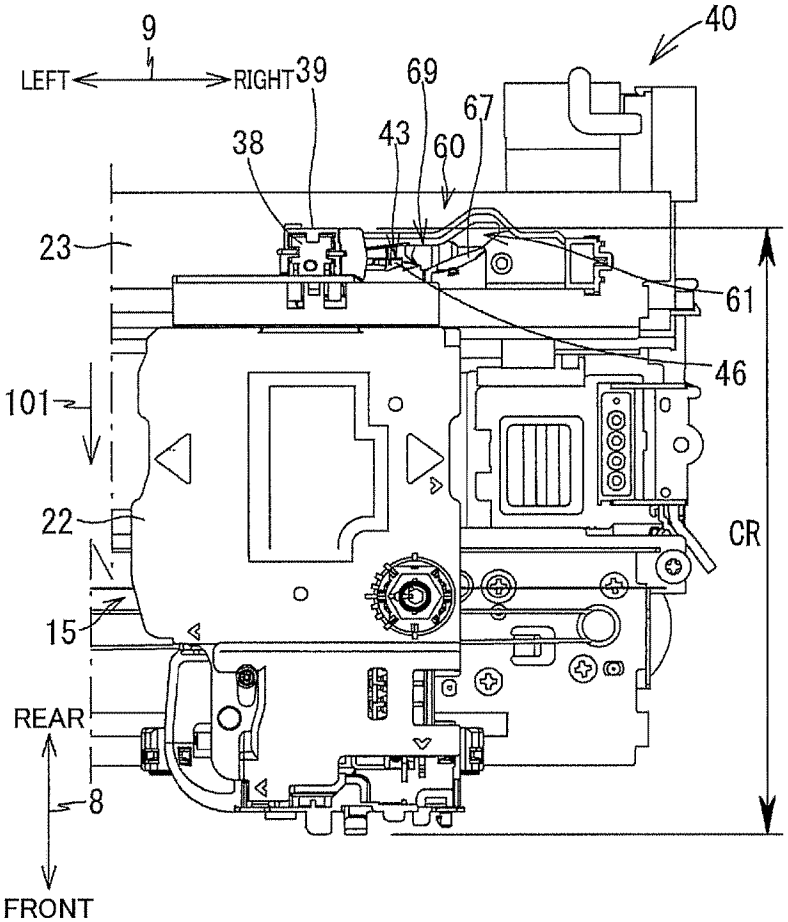
FIG. 3A is a plan view showing a portion of the printer around a carriage and a lever guide.

As shown in FIGS. 4 and 6, the lever guide 60 (as one example of "guide") is disposed above the shaft 42. The lever guide 60 is fixed to the guide rail 23 (FIG. 2). The lever guide 60 is a generally flat plate and has an elongate hole 61 that is long in the right-left direction 9. The lever arm 46 of the lever member 43 is inserted into and passes through the elongate hole 61. A hole 69 (FIGS. 2 and 3) is formed at a portion of the guide rail 23 located above the elongate hole 61, so as to correspond to the elongate hole 61. The lever arm 46 that passes through the elongate hole 61 protrudes upward from the guide rail 23 via the hole 69. A region located above the elongate hole 61 and the hole 69 is a region over which the carriage 22 passes, i.e., a movement region of the carriage 22. That is, the lever arm 46 extends into the movement region of the carriage 22. Here, the movement region of the carriage 22 includes a region over which the carriage 22 is movable in the right-left direction 9 and a region in which the carriage 22 can be present or located in the conveyance direction 101. In FIG. 3, the movement region of the carriage 22 in the conveyance direction 101 is indicated as "CR".

When a guide piece 38 (FIGS. 2 and 3) of the carriage 22 that moves rightward comes into contact with a protruding distal end of the lever arm 46, namely, a portion of the lever arm 46 that protrudes into the movement region of the carriage 22, the protruding distal end of the lever arm 46 is pushed, so that the lever arm 46 moves rightward. The guide piece 38 will be later explained.

As explained below, the bias switching member 44 keeps a rotational posture within a predetermined range with respect to the shaft 42 by the switch arm 49. Depending on the relative positional relationship between the lever member 43 and the bias switching member 44, the rib 47 of the lever member 43 comes into contact with one of the first inclined portion 51 and the second inclined portion 52 of the cutout 50 of the bias switching member 44.

A front edge and a rear edge of the elongate hole 61 are respectively defined by a first edge portion 62 and a second edge portion 63. Specifically, the first edge portion 62 defies the front edge of the elongate hole 61 while the second edge portion 63 defines the rear edge of the elongate hole 61. As described later, the first edge portion 62 and the second edge portion 63 are inclined with respect to the right-left direction 9 at respective predetermined positions. The first edge portion 62 and the second edge portion 63 extend along the right-left direction 9 at the other position except the predetermined positions.

As shown in FIG. 7, the first inclined portion 51 is inclined such that one end thereof remote from the second inclined portion 52 is located more rightward than another end thereof near to the second inclined portion 52. The second inclined portion 52 is inclined such that one end thereof remote from the first inclined portion 51 is located more rightward than another end thereof near to the first inclined portion 51.

Figure 7B:
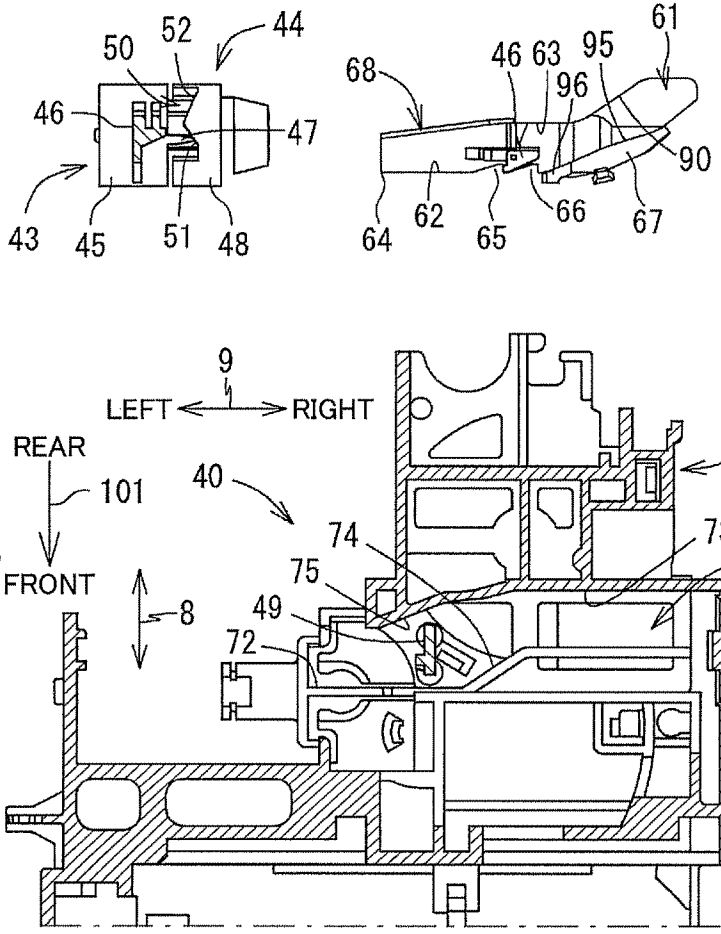
FIG. 7B is a view showing an operation of the drive switching mechanism.
Figure 7A:
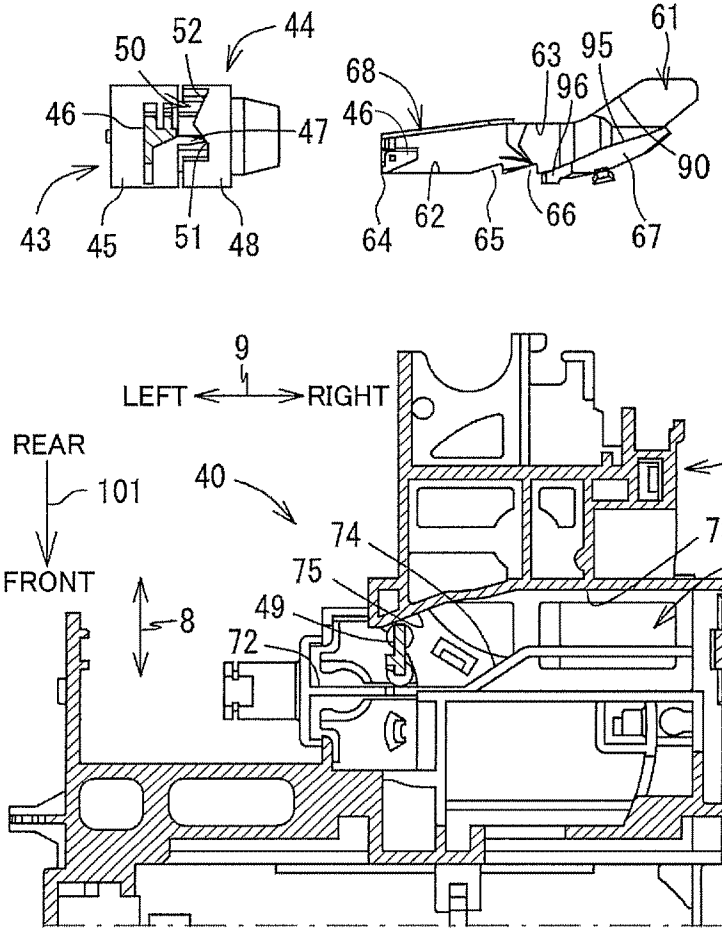
FIG. 7A is a view showing an operation of the drive switching mechanism.
Figure 8B:
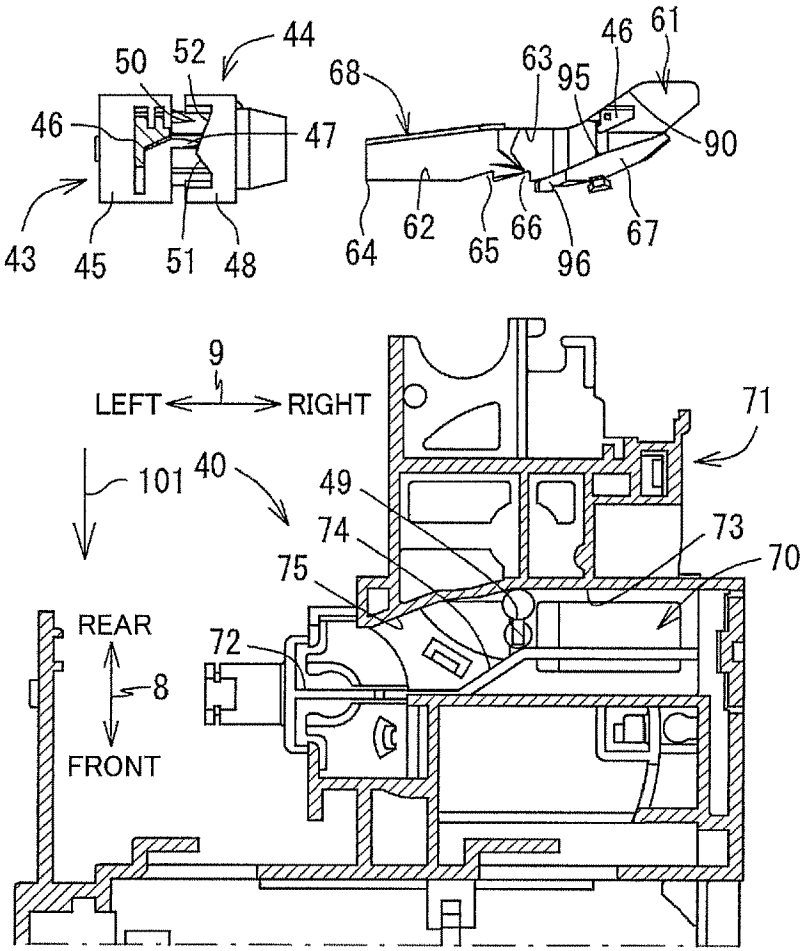
FIG. 8B is a view showing an operation of the drive switching mechanism.

When the rib 47 comes into contact with the first inclined portion 51 as shown in FIG. 7A, the lever arm 46 is biased so as to be rotated with respect to the bias switching member 44 toward the first edge portion 62 of the elongate hole 61. On the other hand, when the rib 47 comes into contact with the second inclined portion 52 as shown in FIG. 8B, the lever arm 46 is biased so as to be rotated with respect to the bias switching member 44 toward the second edge portion 63 of the elongate hole 61.

As shown in FIGS. 4 and 7, a first stopper portion 64, a second stopper portion 65, and a third stopper portion 66 are formed at the first edge portion 62 of the elongate hole 61. Specifically, the first stopper portion 64 is formed at a left end of the elongate hole 61, and the second stopper portion 65 and the third stopper portion 66 are formed so as to be arranged in this order toward the right side. The first stopper portion 64, the second stopper portion 65, and the third stopper portion 66 are one example of a plurality of stoppers.

The second stopper portion 65 and the third stopper portion 66 protrude from the first edge portion 62 toward the second edge portion 63, namely, toward the rear side. The thus protruding second stopper portion 65 and third stopper portion 66 are capable of retaining the lever arm 46 biased leftward, against the biasing force of the coil spring 59. Each of the second stopper portion 65 and the third stopper portion 66 has an inclined surface. The inclined surface is inclined such that its right-side end is located more rearward than its left-side end. When the lever arm 46 slides rightward, the lever arm 46 is guided by the inclined surfaces, whereby the lever arm 46 can pass over the second stopper portion 65 and the third stopper portion 66.

The first stopper portion 64, the second stopper portion 65, and the third stopper portion 66 are configured to retain the lever arm 46 at respective positions corresponding to the respective slide positions of the switch gear 41. That is, the first stopper portion 64, the second stopper portion 65, and the third stopper portion 66 are configured to position the lever arm 46 at the respective positions corresponding to the respective slide positions of the switch gear 41.

When the lever arm 46 is retained by the first stopper portion 64, the switch gear 41 is located at one of its slide positions at which the switch gear 41 meshes with the transmission gear 54. When the lever arm 46 is retained by the second stopper portion 65, the switch gear 41 is located at one of its slide positions at which the switch gear 41 meshes with the transmission gear 55. When the lever arm 46 is retained by the third stopper portion 66, the switch gear 41 is located at one of its slide positions at which the switch gear 41 meshes with the transmission gear 56.

Figure 11:
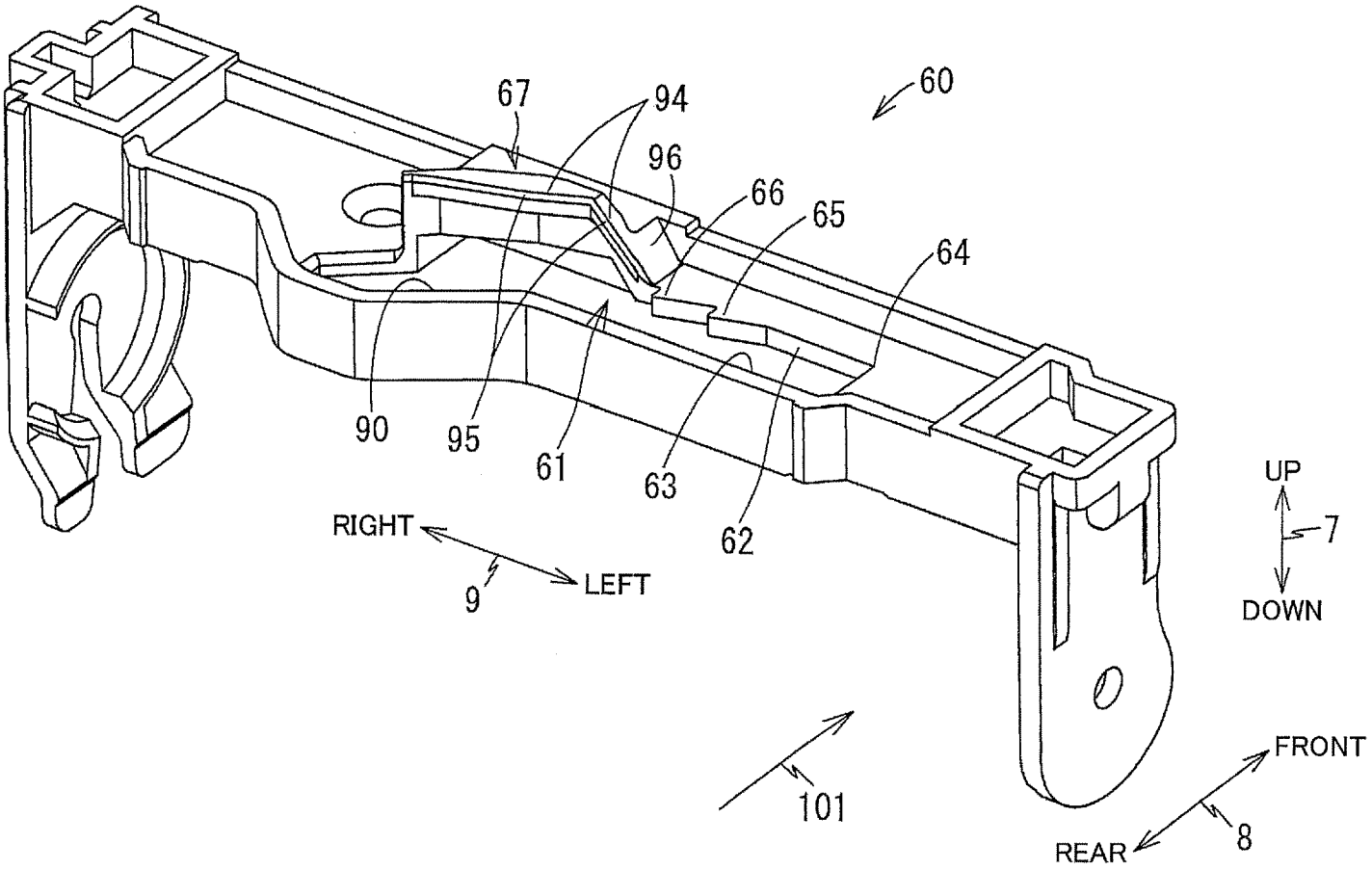
FIG. 11 is a perspective view of the lever guide.

As shown in FIGS. 4 and 11, the first edge portion 62 includes a protruding member 67 (as one example of "inclined portion") which protrudes upward and which is located on the right side of the third stopper portion 66.

As shown in FIG. 11, the protruding member 67 includes a protrusion 94 and two inclined surfaces 95, 96.

The protrusion 94 is formed at a protruding distal end, namely, an upper end, of the protruding member 67. The protrusion 94 protrudes rearward from the protruding distal end. In other words, the protrusion 94 protrudes at the protruding distal end in a direction directed from the first edge portion 62 toward the second edge portion 63.

The inclined surface 95 is a surface of the protrusion 94 facing rearward. The inclined surface 95 is inclined such that its right-side end is located more rearward than its left-side end. That is, the inclined surface 95 is inclined with respect to the right-left direction 9.

The inclined surface 96 is formed at a left end portion of the protruding member 67. The inclined surface 96 is inclined such that its right-side end is located more upward than its left-side end. That is, the protruding member 67 is formed such that the right-side end of the inclined surface 96 (i.e., a downstream end in the right direction) is farther from the axis of the shaft 42 in the radial direction of the shaft 42 than the left-side end of the inclined surface 96 (i.e., an upstream end in the right direction).

The protrusion 94 protrudes rearward from a rear end of the inclined surface 96. That is, the protrusion 94 is formed such that, at the left end portion of the protruding member 67, the height of the protrusion 94 increases toward the right side. At the other portion of the protruding member 67 except the left end portion thereof, namely, at a portion of the protruding member 67 at which the inclined surface 96 is not formed, the protrusion 94 has a constant height. With this configuration, the inclined surface 95 is formed such that its downstream end in the right direction is farther from the axis of the shaft 42 in the radial direction of the shaft 42 than its upstream end in the right direction.

The lever arm 46 that slides rightward along the first edge portion 62 comes into contact with the inclined surface 95 of the protruding member 67, so that the lever arm 46 is guided rearward. Thus, the lever arm 46 pivots in a direction indicated by an arrow 105 in FIG. 6, such that the posture of the lever arm 46 changes from a posture indicated by the solid line in FIG. 6 to a posture indicated by the dashed line in FIG. 6.

As shown in FIG. 6, a distance L1 in the radial direction of the shaft 42 between: a first position P1 at which the inclined surface 95 and the lever arm 46 contact each other; and the axis of the shaft 42 is larger than a distance L2 in the radial direction of the shaft 42 between: a second position P2 at which the stopper portion (the first stopper portion 64, the second stopper portion 65, and the third stopper portion 66) and the lever arm 46 contact each other; and the axis of the shaft 42. Here, the first position P1 is a position at which the inclined surface 95 and the lever arm 46 contact except the left end portion of the inclined surface 95 (at which the inclined surface 96 is formed).

A distance L3 in the radial direction of the shaft 42 between: a third position P3 at which the carriage 22 and the lever arm 46 contact each other (i.e., the position of the protruding distal end of the lever arm 46); and the first position P1 is smaller than a distance L4 in the radial direction of the shaft 42 between: the third position P3 and the second position P2.

As shown in FIGS. 4 and 7, a guide portion 90 is formed at a position of the second edge portion 63 of the elongate hole 61 at which the guide portion 90 is opposed to the protruding member 67. The guide portion 90 is an inclined surface that is inclined from the right end of the second edge portion 63 such that its left end portion is located more forward than its right end portion.

The right end portion of the guide portion 90 extends rearward beyond the movement region CR of the carriage 22. The left end portion of the guide portion 90 extends into and is located in the movement region CR of the carriage 22 in the conveyance direction 101.

A third inclined portion 68 is formed at a position of the second edge portion 63 of the elongate hole 61 at which the third inclined portion 68 is opposed to the first stopper portion 64. The third inclined portion 68 is inclined such that its left-side end is located more forward than its right-side end. The lever arm 46 that slides leftward along the second edge portion 63 is guided toward the front side by the third inclined portion 68.

Arm Guide 70

As shown in FIGS. 4 and 6, the arm guide 70 is disposed below the shaft 42. The arm guide 70 is a part of a frame 71 that supports the shaft 42 and the lever guide 60. The arm guide 70 is a groove which is long in the right-left direction 9 and which is open upward. A distal end portion of the switch arm 49 of the bias switching member 44 extends into the arm guide 70.

A front end of the arm guide 70, namely, a downstream end of the arm guide 70 in the conveyance direction 101, is defined by a third edge portion 72. A rear end of the arm guide 70, namely, an upstream end of the arm guide 70 in the conveyance direction 101, is defined by a fourth edge portion 73. The distal end portion of the switch arm 49 of the bias switching member 44 comes into contact selectively with one of the third edge portion 72 and the fourth edge portion 73, whereby the bias switching member 44 slides in the right-left direction 9 while being kept at a rotational position in the circumferential direction of the shaft 42 within a predetermined range.

As shown in FIG. 7, the inner surface of the third edge portion 72 extends generally in the right-left direction 9. A fifth inclined portion 74 is formed at a position of the third edge portion 72 corresponding to the protruding member 67 of the lever guide 60. The fifth inclined portion 74 is inclined such that its right-side end is located more rearward than its left-side end. The switch arm 49 moves rightward along the fifth inclined portion 74, whereby the bias switching member 44 is rotated about the shaft 42 such that the rib 47 of the lever member 43 that is in contact with the first inclined portion 51 of the bias switching member 44 moves toward the second inclined portion 52.

The inner surface of the fourth edge portion 73 extends generally in the right-left direction 9. A sixth inclined portion 75 is formed so as to extend rightward from a position of the fourth edge portion 73 corresponding to at least the first stopper portion 64 of the lever guide 60. The sixth inclined portion 75 is inclined such that its left-side end is located more forward than its right-side end. The switch arm 49 moves leftward along the sixth inclined portion 75, whereby the bias switching member 44 is rotated about the shaft 42 such that the rib 47 of the lever member 43 that is in contact with the second inclined portion 52 of the bias switching member 44 moves toward the first inclined portion 51.

Guide Piece 38

As shown in FIG. 2, the guide piece 38 is disposed at a rear end of the carriage 22, namely, at an upstream end of the carriage 22 in the conveyance direction 101, so as to protrude rearward. The guide piece 38 reciprocates with the carriage 22. When the guide piece 38 moves rightward, the guide piece 38 comes into contact with the protruding distal end of the lever arm 46 of the lever member 43, so that the lever arm 46 moves rightward.

Switching of Transmission of Drive Force by Drive Switching Mechanism 40

Hereinafter, there will be explained a manner of switching transmission of the drive force of the motor by the sliding movement of the switch gear 41 to the transmission gears 54, 55, 56, 57.

As shown in FIG. 7A, when the lever arm 46 is retained by the first stopper portion 64 of the lever guide 60, the distal end portion of the switch arm 49 of the bias switching member 44 is in contact with a part of the third edge portion 72 of the arm guide 70 located leftward of the fifth inclined portion 74. In this state, the rib 47 of the lever member 43 is in contact with the first inclined portion 51 of the bias switching member 44, and the lever member 43 and the bias switching member 44 are biased by the two coil springs 58, 59 so as to be in contact with each other. Thus, the rib 47 is guided by the first inclined portion 51. Accordingly, the lever arm 46 is biased in a direction directed from the second edge portion 63 of the lever guide 60 toward the first edge portion 62 thereof. That is, the bias switching member 44 biases the lever member 43 in the direction directed from the second edge portion 63 toward the first edge portion 62. Consequently, the lever arm 46 is kept retained by the first stopper portion 64. When the lever member 43 is located at this position, the switch gear 41 is held at a position at which the switch gear 41 meshes with the transmission gear 54. Thus, the drive force of the motor 30 is transmitted to the sheet-supply roller 13, so that the sheet-supply roller 13 is rotated so as to supply the sheet from the sheet-supply tray 11.

When the guide piece 38 of the carriage 22 comes into contact with the lever arm 46 and moves rightward in the state shown in FIG. 7A, the lever arm 46 is moved from the first stopper portion 64 to the second stopper portion 65. Further, the bias switching member 44 is pushed by the lever arm 46 so as to move rightward. When the lever arm 46 is moved rightward, the switch gear 41 is moved rightward following the lever arm 46 by the biasing force of the coil spring 58.

When the lever arm 46 is retained by the second stopper portion 65 as shown in FIG. 7B, the distal end portion of the switch arm 49 of the bias switching member 44 is in contact with a part of the third edge portion 72 of the arm guide 70 located leftward of the fifth inclined portion 74. In this state, the rib 47 of the lever member 43 is in contact with the first inclined portion 51 of the bias switching member 44, and the lever member 43 and the bias switching member 44 are biased by the two coil springs 58, 59 so as to be in contact with each other. Thus, the rib 47 is guided along the first inclined portion 51. Accordingly, the lever arm 46 is biased toward the first edge portion 62 of the lever guide 60, and the lever arm 46 is kept retained by the second stopper portion 65. When the lever member 43 is located at this position, the switch gear 41 is held at the position at which the switch gear 41 meshes with the transmission gear 55. Thus, the drive force of the motor 30 is transmitted to the lower sheet-supply roller, so that the lower sheet-supply roller is rotated so as to supply the sheet from the lower tray.

When the guide piece 38 of the carriage 22 comes into contact with the lever arm 46 and moves rightward in the state shown in FIG. 7B, the lever arm 46 is moved from the second stopper portion 65 to the third stopper portion 66. Further, the bias switching member 44 is pushed by the lever arm 46 so as to move rightward. When the lever arm 46 is moved rightward, the switch gear 41 is moved rightward following the lever arm 46 by the biasing force of the coil spring 58.

Figure 8A:
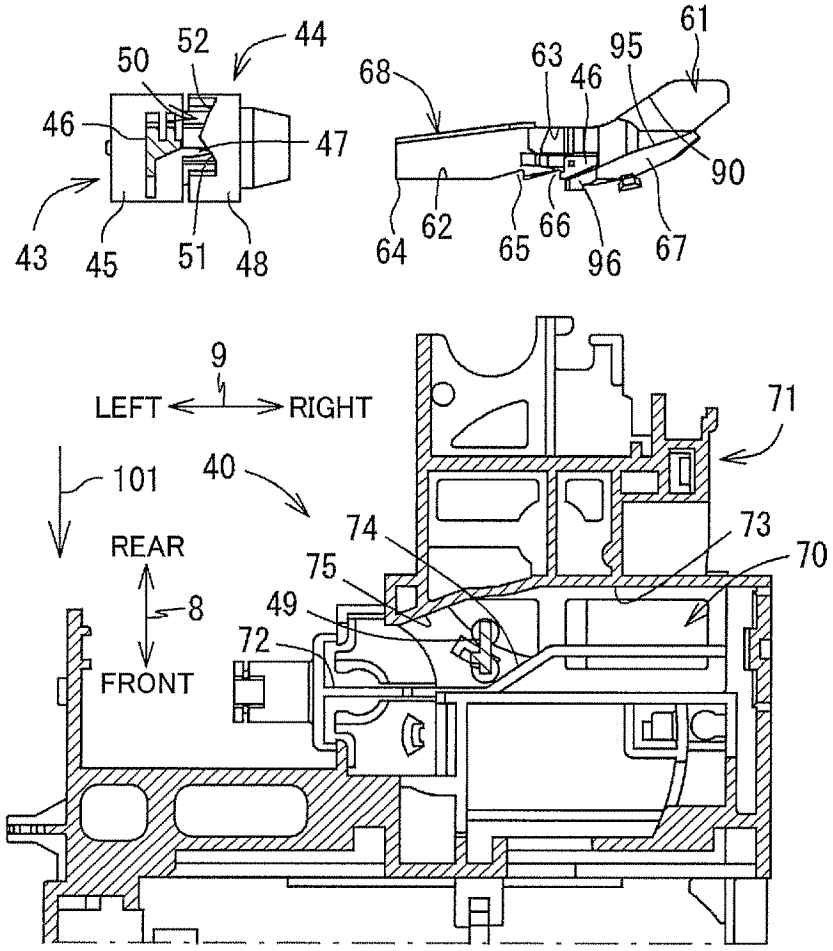
FIG. 8A is a view showing an operation of the drive switching mechanism.

When the lever arm 46 is retained by the third stopper portion 66 as shown in FIG. 8A, the distal end portion of the switch arm 49 of the bias switching member 44 is in contact with a part of the third edge portion 72 of the arm guide 70 located near the left-side end of the fifth inclined portion 74. In this state, the rib 47 of the lever member 43 is in contact with the first inclined portion 51 of the bias switching member 44, and the lever member 43 and the bias switching member 44 are biased by the two coil springs 58, 59 so as to be in contact with each other. Thus, the rib 47 is guided along the first inclined portion 51. Accordingly, the lever arm 46 is biased toward the first edge portion 62 of the lever guide 60, and the lever arm 46 is kept retained by the third stopper portion 66. When the lever member 43 is located at this position, the switch gear 41 is held at the position at which the switch gear 41 meshes with the transmission gear 56. Thus, the drive force of the motor 30 is transmitted to the re-conveyance roller, so that the re-conveyance roller is rotated so as to convey the sheet located on the return passage.

When the guide piece 38 of the carriage 22 located at the position shown in FIG. 8A comes into contact with the lever arm 46 and moves rightward, the lever arm 46 is further moved rightward from the third stopper portion 66. Further, the bias switching member 44 is pushed by the lever arm 46 so as to move rightward. When the lever arm 46 is moved rightward, the switch gear 41 is moved rightward following the lever arm 46 by the biasing force of the coil spring 58.

When the lever arm 46 moves rightward from the third stopper portion 66, the lever arm 46 moves along the protruding member 67 of the lever guide 60. Specifically, the lever arm 46 is guided by the inclined surface 95 (FIG. 11) of the protrusion 94 formed at the protruding distal end of the protruding member 67 while being held in contact with the inclined surface 95. As described above, the protrusion 94 is formed such that, at the left end portion of the protruding member 67, the height of the protrusion 94 increases toward the right side. Thus, the height level of the contact position of the lever arm 46 and the inclined surface 95 increases as the lever arm 46 moves rightward. Finally, the contact position becomes equal to the first position P1 (FIG. 6).

As described above, the inclined surface 95 is inclined such that its right-side end is located more rearward than its left-side end. Thus, the lever arm 46 guided along the inclined surface 95 moves rightward and also pivots toward the rear side, namely, toward the second edge portion 63.

Further, the bias switching member 44 is pushed by the lever arm 46 so as to move rightward, so that the distal end portion of the switch arm 49 of the bias switching member 44 moves along the fifth inclined portion 74 of the third edge portion 72 of the arm guide 70.

Thus, the lever member 43 and the bias switching member 44 are rotated relative to each other about the shaft 42 in opposite directions. As a result, the rib 47 of the lever member 43 is moved from the position at which the rib 47 is in contact with the first inclined portion 51 of the bias switching member 44 to the position at which the rib 47 is in contact with the second inclined portion 52 of the bias switching member 44. The lever member 43 and the bias switching member 44 are biased by the two coil springs 58, 59 so as to be in contact with each other. Thus, the rib 47 is guided along the second inclined portion 52, and the lever arm 46 is accordingly biased in the direction directed from the first edge portion 62 of the lever guide 60 toward the second edge portion 63 thereof. As a result, the lever arm 46 comes into contact with the guide portion 90, as shown in FIG. 8B.

That is, the bias switching member 44 acts on the lever arm 46 guided along the inclined surface 95 by the sliding movement of the lever member 43 in the right-left direction 9, thereby changing the direction in which the lever arm 46 is biased from the direction directed from the second edge portion 63 toward the first edge portion 62 to the direction directed from the first edge portion 62 toward the second edge portion 63.

When the carriage 22 is further moved rightward from the position shown in FIG. 8B, the lever arm 46 biased toward the second edge portion 63 is moved rightward along the guide portion 90 opposed to the protruding member 67, so that the lever arm 46 is moved rearward as well as rightward. Consequently, when the lever arm 46 is located more rightward than the guide portion 90, the lever arm 46 is located more rearward than the carriage 22 as shown in FIGS. 3B and 9A, so that the lever arm 46 is no longer pushed rightward by the carriage 22. In this instance, the lever arm 46 is sandwiched by and between the second edge portion 63 and the rear surface 39 of the guide piece 38, as shown in FIG. 3B. Thus, the lever arm 46 is prohibited from moving leftward by the guide piece 38.

The position of the carriage 22 at this time is a position at which the recording head 21 is covered by the cap 36. When the lever member 43 is thus located, the switch gear 41 is held at the position at which the switch gear 41 meshes with the transmission gear 57. Thus, the drive force of the motor 30 is transmitted to the purge mechanism 34, so that the purge mechanism 34 is driven to remove the air bubbles and the foreign matters from the nozzles of the recording head 21.

When the carriage 22 moves leftward from the position shown in FIG. 9A, the guide piece 38 moves away from the lever arm 46, whereby the lever arm 46 is biased leftward by the coil spring 59 and accordingly slides leftward along the guide portion 90. Further, the bias switching member 44 and the switch gear 41 also slide leftward by being biased by the coil spring 59.

Figure 9B:
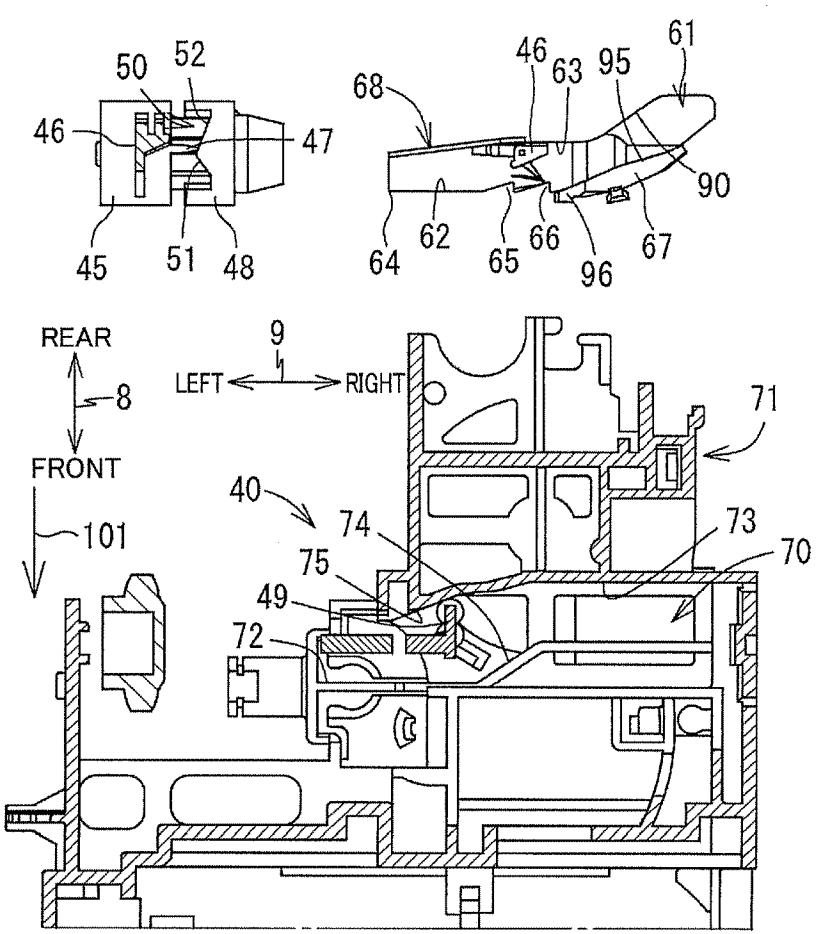
FIG. 9B is a view showing an operation of the drive switching mechanism.
Figure 9A:
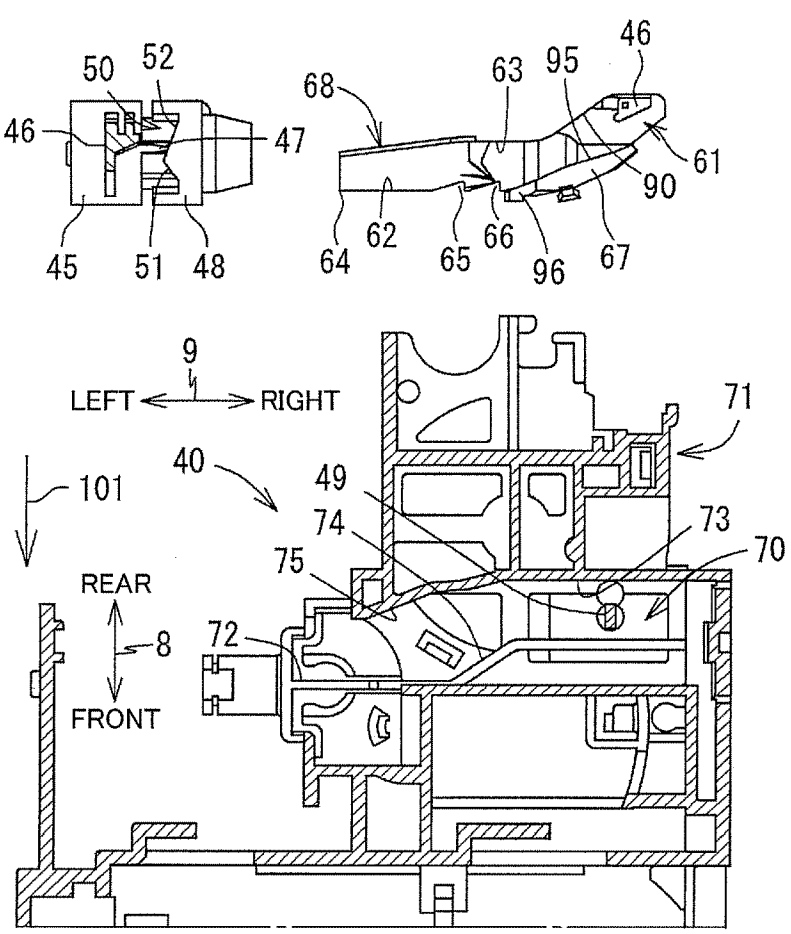
FIG. 9A is a view showing an operation of the drive switching mechanism.
Figure 10:
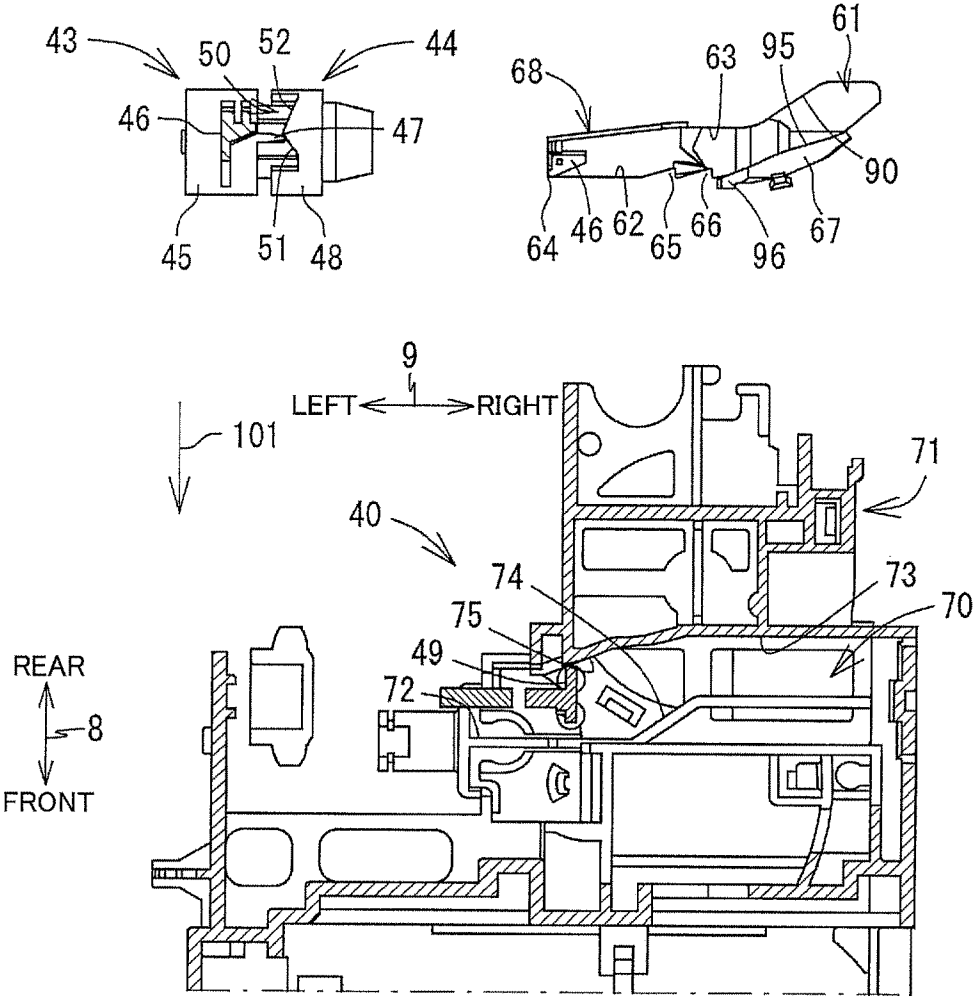
FIG. 10 is a view showing an operation of the drive switching mechanism.

As shown in FIG. 9B, during the movement of the lever arm 46 leftward along the second edge portion 63, the distal end portion of the switch arm 49 of the bias switching member 44 reaches the sixth inclined portion 75 of the fourth edge portion 73 of the arm guide 70 and moves along the sixth inclined portion 75. Further, the lever arm 46 moves along the third inclined portion 68 of the second edge portion 63. Thus, the lever member 43 and the bias switching member 44 rotate relative to each other about the shaft 42 in opposite directions, so that the rib 47 of the lever member 43 moves from the position at which the rib 47 is in contact with the second inclined portion 52 of the bias switching member 44 to the position at which the rib 47 is in contact with the first inclined portion 51 of the bias switching member 44, as shown in FIG. 10. The lever member 43 and the bias switching member 44 are biased by the two coil springs 58, 59 so as to be in contact with each other. Thus, the rib 47 is guided along the first inclined portion 51, whereby the lever arm 46 is biased toward the first edge portion 62 of the lever guide 60. Consequently, the lever arm 46 is retained by the first stopper 64 of the lever guide 60, as shown in FIG. 7A.

Advantageous Effects of Embodiment

The lever arm 46 moves along the inclined surface 95 while being in contact with the inclined surface 95, so as to pivot toward the second edge portion 63. In this instance, the lever arm 46 receives a load due to a sliding resistance generated when the lever arm 46 slides along the inclined surface 95.

According to the present embodiment, the distance L1 in the radial direction of the shaft 42 between: the first position P1 at which the inclined surface 95 and the lever arm 46 contact each other; and the axis of the shaft 42 is larger than the distance L2 in the radial direction of the shaft 42 between: the second position P2 at which each of the plurality of stopper portions (the first stopper portion 64, the second stopper portion 65, and the third stopper portion 66) contacts the lever arm 46; and the axis of the shaft 42. It is noted that the torque by which the lever arm 46 is pivoted increases with an increase in a distance away from the shaft 42 in the radial direction. Thus, the torque when the lever arm 46 contacts the inclined surface 95 is larger than that when the lever arm 46 contacts each stopper portion. The larger torque enables the lever arm 46 to keep pivoting against the load described above.

In an instance where the position at which the stopper portion and the lever arm 46 contact each other is spaced apart or distant from the shaft 42 in the radial direction, an amount of movement of the lever arm 46 in the circumferential direction when pivots becomes large. In this instance, the stopper portion needs to have a larger size for ensuring that the lever arm 46 is retained by the stopper portion with high reliability. According to the present embodiment, however, the distance L2 is smaller than the distance L1. That is, the position at which the stopper portion and the lever arm 46 contact each other is closer to the shaft 42, so that the lever arm 46 can be reliably retained by the stopper portion without increasing the size of the stopper portion.

In an instance where the third position P3 at which the carriage 22 and the lever arm 46 contact each other is spaced apart or distant, in the radial direction, from the first position P1 at which the inclined surface 95 and the lever arm 46 contact each other, there may be a risk that the lever arm 46 is twisted when the carriage 22 contacts and pushes the lever arm 46 and the lever arm 46 is accordingly guided along the inclined surface 95. If the lever arm 46 is twisted, the sliding resistance between the lever arm 46 and the inclined surface 95 undesirably becomes large when the lever arm 46 moves along the inclined surface 95 while being in contact with the inclined surface 95.

According to the present embodiment, the distance L3 in the radial direction of the shaft 42 between the third position P3 and the first position P1 is smaller than the distance L4 in the radial direction of the shaft 42 between the third position P3 and the second position P2. This configuration enables the sliding resistance between the lever arm 46 and the inclined surface 95 to be smaller, as compared with a case in which the printer 10 is configured such that the distance L3 is equal to or larger than the distance L4.

Even when the protruding member 67 protrudes from the first edge portion 62 in the radial direction, there may be a risk that the lever arm 46 comes into contact with the proximal portion of the protruding member 67, resulting in a reduction in the distance in the radial direction between: the position at which the protruding member 67 and the lever arm 46 contact each other; and the axis of the shaft 42.

According to the present embodiment, the protrusion 94 formed at the protruding distal end of the protruding member 67 has the inclined surface 95. This configuration enables the lever arm 46 to come into contact with the protruding distal end of the protruding member 67, not with the proximal portion thereof. Thus, it is possible to increase the distance in the radial direction between: the position at which the protruding member 67 and the lever arm 46 contact each other; and the axis of the shaft 42.

In an instance where the protruding member 67 protrudes from the first edge portion 62 in the radial direction, the lever arm 46, which is pushed by the carriage 22 and moves rightward, may get caught on the left end portion of the protruding member 67. According to the present embodiment, the protruding member 67 includes the inclined surface 96, so that the amount of protrusion of the protruding member 67 in the radial direction increases from the left end portion of the protruding portion toward the right side. This configuration lowers the risk described above that the lever arm 46 gets caught on the protruding member 67.

According to the present embodiment, both of the switch gear 41 and the lever member 43 are supported by the shaft 42, making it possible to easily achieve the configuration in which the switch gear 41 slides along the right-left direction 9 in accordance with the sliding movement of the lever member 43.

According to the present embodiment, when the carriage 22 pushes the lever arm 46 rightward, the lever arm 46 is moved away from the switch gear 41. Consequently, the switch gear 41 can be slid rightward by the biasing force of the coil spring 58. When the carriage 22 separates away from the lever arm 46, the lever arm 46 that slides leftward by the biasing force of the coil spring 59 pushes the switch gear 41, so that the switch gear 41 can be slid leftward.

According to the present embodiment, the direction in which the bias switching member 44 biases the lever member 43 is changed to the direction directed toward the second edge portion 63, whereby the lever member 43 can be disengaged from the stopper portions (the first stopper portion 64, the second stopper portion 65, and the third stopper portion 66).

Modified Embodiment

Figure 12:
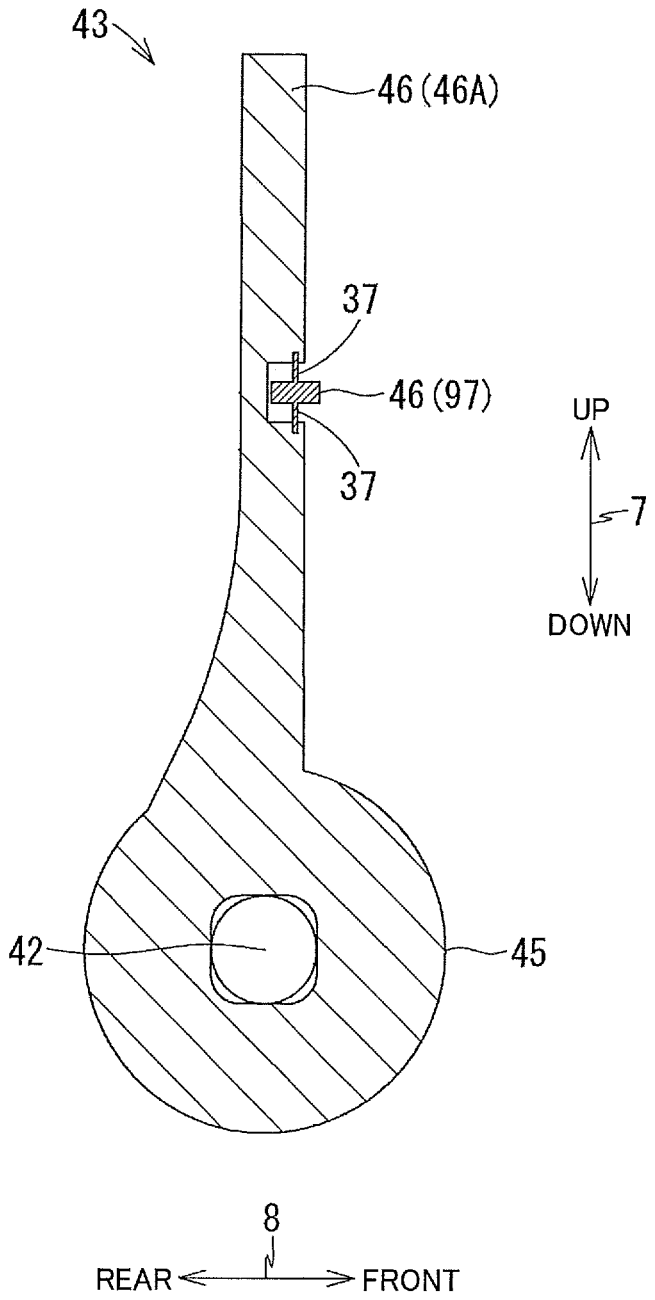
FIG. 12 is a cross-sectional view of the lever member having a roller.

As shown in FIG. 12, the lever arm 46 may include a roller 97 (as one example of "low friction member"). The roller 97 is supported by a main body 46A of the lever arm 46 so as to be rotatable about a shaft 37 that extends in the up-down direction 7. The roller 97 is disposed so as to be positioned at the same height level as the inclined surface 95 of the protruding member 67. When the lever arm 46 slides rightward along the first edge portion 62, the roller 97 comes into contact with the inclined surface 95 of the protruding member 67. The roller 97 is rotatable when being guided by the inclined surface 95. With this configuration, in the sliding movement of the lever arm 46, a friction force generated when the roller 97 comes into contact with the inclined surface 95 is smaller than a friction force generated when other portion of the lever arm 46 except the roller 97, namely, the main body 46A of the lever arm 46, comes into contact with the inclined surface 95.

It is noted that a means for decreasing the friction force generated when the lever arm 46 comes into contact with the inclined surface 95 is not limited to the roller 97. For instance, a member having a low friction coefficient, such as fluororesin, may be bonded or may cover a portion of the lever arm 46 which is to come into contact with the inclined surface 95.

According to the modified embodiment, the low friction member such as the roller 97 comes into contact with the inclined surface 95, so that the sliding resistance between the lever arm 46 and the inclined surface 95 can be reduced.

In the embodiment illustrated above, the third position P3 at which the carriage 22 and the lever arm 46 contact each other is located at a height level higher than the first position P1 at which the inclined surface 95 and the lever arm 46 contact each other, as shown in FIG. 6. Further, the first position P1 is located at a height level higher than the second position P2 at which each stopper portion 64, 65, 66 and the lever arm 46 contact each other. Moreover, the second position P2 is located at a height level higher than the shaft 42. As long as the distance L1 in the radial direction of the shaft 42 between the first position P1 and the axis of the shaft 42 is larger than the distance L2 in the radial direction of the shaft 42 between the second position P2 and the axis of the shaft 42, the positional relationship among the first position P1, the second position P2, the third position P3, and the shaft 42 in the up-down direction is not limited to that described above. For instance, the first position P1 may be located at a height level higher than the axis of the shaft 42 while the second position P2 may be located at a height level lower than the axis of the shaft 42.

In the embodiment illustrated above, as shown in FIG. 6, the distance L3 in the radial direction of the shaft 42 between the third position P3 and the first position P1 is smaller than the distance L4 in the radial direction of the shaft 42 between the third position P3 and the second position P2. The distance L3 may be equal to or larger than the distance L4.

In the embodiment illustrated above, the protruding member 67 has, at its protruding distal end, the protrusion 94, and the protrusion 94 has the inclined surface 95 with which the lever arm 46 comes into contact. The protruding member 67 does not necessarily have to have the protrusion 94. For instance, the protruding member 67 may be formed so as to protrude obliquely upward toward the second edge portion 63, and the inclined surface 95 may be formed at the protruding distal end of the protruding member 67.

In the embodiment illustrated above, the protruding member 67 has the inclined surface 96. The protruding member 67 does not necessarily have to have the inclined surface 96.

In the embodiment illustrated above, the switch gear 41, the lever member 43, and the bias switching member 44 are supported by the same shaft 42. The switch gear 41, the lever member 43, and the bias switching member 44 may be supported by respective different shafts.

In the embodiment illustrated above, the switch gear 41, the lever member 43, and the bias switching member 44 are biased by the two coil springs 58, 59. The number of the coil springs is not limited to two.

For instance, the switch gear 41, the lever member 43, and the bias switching member 44 may be biased leftward only by the coil spring 59. In this instance, the lever member 43 is positioned on the left side of the switch gear 41 and the bias switching member 44. In this configuration, when the lever member 43 is pushed by the guide piece 38 of the carriage 22 that moves rightward, the lever member 43, the switch gear 41, and the bias switching member 44 are moved rightward against the biasing force of the coil spring 59. On the other hand, when the carriage 22 moves leftward and separates away from the lever member 43, the lever member 43, the switch gear 41, and the bias switching member 44 are moved leftward by the biasing force of the coil spring 59.

In the embodiment illustrated above, the printer 10 includes the bias switching member 44. The bias switching member 44 may be eliminated. In this case, the lever member 43 is biased toward the first edge portion 62 by a spring not shown, for instance. The lever arm 46 moves along the inclined surface 95 of the protruding member 67, so that the lever member 43 pivots toward the second edge portion 63 against the biasing force of the spring.

In the embodiment illustrated above, the coil spring functions as the biasing member. The biasing member is not limited to the coil spring, but may be a flat spring, for instance.

What is claimed is:

1. An ink-jet recording apparatus, comprising:

a carriage on which a recording head is mounted and which is configured to reciprocate in a main scanning direction composed of a first direction and a second direction which are opposite to each other;

a lever including a lever arm that protrudes into a movement region of the carriage and configured to be slidable in the main scanning direction and rotatable about an axis of a shaft supporting the lever, the axis being parallel to the main scanning direction;

a first gear configured to rotate by a drive force transmitted from a drive source;

a second gear meshing with the first gear and configured to be slidable to a plurality of slide positions along the main scanning direction in accordance with a sliding movement of the lever;

a plurality of transmission gears parallelly disposed so as to correspond to the plurality of slide positions of the second gear, each of the plurality of transmission gears being configured to mesh with the second gear at a corresponding one of the plurality of slide positions of the second gear;

a guide having an elongate hole into which the lever arm is inserted, the guide being configured to position the lever arm with respect to a plurality of positions corresponding to the plurality of slide positions of the second gear; and a biasing member configured to bias the lever, wherein the elongate hole is defined by a periphery including a first edge portion and a second edge portion which extend in the main scanning direction and which are opposed to each other, the first edge portion including a plurality of stoppers by each of which the lever arm is retained at a corresponding one of the plurality of positions, wherein the guide comprises an inclined portion including an inclined surface and formed at the first edge portion so as to be located downstream of the stoppers in the first direction in which the carriage pushes the lever arm, the inclined surface being inclined with respect to the main scanning direction and configured to contact the lever arm so as to rotate the lever arm toward the second edge portion, wherein the biasing member biases the lever in the second direction opposite to the first direction and in a direction directed from the second edge portion toward the first edge portion, and wherein a distance in a radial direction of the shaft between: a first position at which the inclined surface and the lever arm contact each other; and the axis of the shaft is larger than a distance in the radial direction of the shaft between: a second position at which each of the stoppers contacts the lever arm; and the axis of the shaft.

2. The ink-jet recording apparatus according to claim 1, wherein a distance in the radial direction of the shaft between: a third position at which the carriage and the lever arm contact each other; and the first position is smaller than a distance in the radial direction of the shaft: between the third position and the second position.

3. The ink-jet recording apparatus according to claim 1,
wherein the inclined portion protrudes from the first edge portion in the radial direction of the shaft,
wherein the inclined portion has, at its distal end, a protrusion that protrudes in a direction directed from the first edge portion toward the second edge portion, and
wherein the inclined surface is formed at the protrusion.

4. The ink-jet recording apparatus according to claim 1,
wherein the inclined portion protrudes from the first edge portion in the radial direction of the shaft, and
wherein the inclined portion is inclined such that a downstream end in the first direction is farther from the axis of the shaft in the radial direction of the shaft than an upstream end in the first direction.

5. The ink-jet recording apparatus according to claim 1, wherein the second gear is supported by the shaft.

6. The ink-jet recording apparatus according to claim 5,
wherein the lever is disposed downstream of the second gear in the first direction, and
wherein the biasing member includes a first spring disposed on the shaft so as to be located downstream of the second gear in the second direction and a second spring disposed on the shaft so as to be located downstream of the lever in the first direction, a biasing force of the second spring being larger than that of the first spring.

7. The ink-jet recording apparatus according to claim 1, wherein the biasing member includes a bias switching member configured to switch a direction in which the lever is biased from the direction directed from the second edge portion toward the first edge portion to a direction directed from the first edge portion to the second edge portion, by a force that acts on the lever arm from the inclined surface when the lever slides in the main scanning direction.

8. The ink-jet recording apparatus according to claim 1,
wherein the lever arm includes a low friction member configured to come into contact with the inclined surface, and
wherein the low friction member comes into contact with the inclined surface with a friction force smaller than that when other portion of the lever arm except the low friction member comes into contact with the inclined surface.

* * * * *